US005791469A

United States Patent [19]

Be

[11] Patent Number: 5,791,469

[45] Date of Patent: Aug. 11, 1998

[54] BOWLING BALL CARRIER

[76] Inventor: Sung Hoan Be, 887-50 Kumdan-Dong Buk-Gu, Taegu, Rep. of Korea

[21] Appl. No.: 856,060

[22] Filed: May 14, 1997

[51] Int. Cl.[6] ..... A45C 5/14

[52] U.S. Cl. ..... 206/315.91; 190/18 A; 280/47.19

[58] Field of Search ..... 190/18 A; 206/315.9, 206/315.91, 579; 280/35, 47.18, 47.19, 47.26, 655, 659

[56] References Cited

U.S. PATENT DOCUMENTS

| | | | |
|---|---|---|---|
| 3,281,883 | 11/1966 | Glantz | 206/315.91 |
| 4,066,156 | 1/1978 | Basile | 206/315.1 |
| 5,295,565 | 3/1994 | Latshaw | 190/18 A |
| 5,374,073 | 12/1994 | Hung-Hsin | 190/18 A |
| 5,607,175 | 3/1997 | Bae | 206/315.91 |
| 5,639,109 | 6/1997 | Liang | 190/18 A |
| 5,730,264 | 3/1998 | Lu | 190/18 A |

*Primary Examiner*—Jimmy G. Foster
*Attorney, Agent, or Firm*—Richard T. Holzmann

[57] ABSTRACT

A bowling ball carrier, carrying a plurality of bowling balls at the same time and allowing a user to receive or take bowling balls into or out of bowling ball bags and being selectively used as a travelling carrier, is disclosed. The bowling ball carrier has a telescopic handle frame and an integrated bag provided on the lower end of the handle frame by attaching the bottom part of the integrated bag to the lower end of the handle frame. A support block is placed in the bottom part of the bag. Both side walls of the support block are rounded inwardly at the same radius of gyration as a bowling ball thus forming bow side surfaces. An upper bag holder frame is attached to the handle frame at a position above the integrated bag and is supported by the support block.

13 Claims, 14 Drawing Sheets

BOWLING BALL CARRIER

BACKGROUND OF THE INVENTION

1. Field of the Invention

The present invention relates, in general, to a bowling ball carrier and, more particularly, to a bowling ball carrier having at least one bowling ball bag and easily carrying a plurality of bowling balls and being selectively used as a travelling carrier.

2. Description of the Prior Art

Typically, most bowlers individually use several bowling balls with different colors, weights and finger holes in accordance with one's liking or in an effort to train systematically or to enjoy oneself by bowling positively. In this regard, it is necessary for some bowlers to carry a plurality of bowling balls at the same time.

In order to carry a plurality of bowling balls in the prior art, two or more bags receiving the bowling balls are loaded on a conventional wheeled carrier prior to fastening the bags together with the carrier into a wheeled package by a fastening means such as a cord. However, such a carrier is inconvenient to users since the bags on the carrier have to be unfastened prior to unloading the uppermost bag from the carrier when it is necessary to take a bail out of a lower bag of the above fastened bags. When the bowling ball bags are carried as described above, the bags may be easily deformed and damaged due to the weight of the upper bags so that the owner is forced to purchase new ones. Meanwhile, the conventional carrier may be used for carrying travelling bags such as trunks or suitcases. In this case, a main travelling bag is seated on the bottom holder of the carrier, while an auxiliary bag is held on the top of the main bag prior to fastening the bags together with the carrier by a fastening means such as a cord. Therefore, both the main and auxiliary bags may be deformed and allow unexpected damage to their contents.

SUMMARY OF THE INVENTION

Accordingly, the present invention has been made keeping in mind the above problems occurring in the prior art, and an object of the present invention is to provide a bowling ball carrier, which effectively and stably holds two or more bags without deforming the bags or damaging the contents of the bags and allows a user to easily and simply receive or take bowling balls into or out of the bags, and which is selectively and preferably used as a travelling carrier free from causing deformation of travelling bags or damage of the contents of the bags.

In order to accomplish the above object, the present invention provides a bowling ball carrier comprising: a handle frame having a telescopic structure; an integrated bag provided on the lower end of the handle frame by attaching the bottom part of the bag to the lower end of the handle frame; a support block placed in the bottom part of the bag; and an upper bag holder frame used for holding an additional bag thereon, the upper bag holder frame being attached to the handle frame at a position above the integrated bag and supported by the support block.

BRIEF DESCRIPTION OF THE DRAWINGS

The above and other objects, features and other advantages of the present invention will be more clearly understood from the following detailed description taken in conjunction with the accompanying drawings, in which:

FIG. 1 is a perspective view ox a bowling ball carrier, with an integrated bag lying on its side thus allowing a user to receive or take bowling balls into or out of the bags from the front, in accordance with the primary embodiment of the present invent on;

FIGS. 12A and 12B are perspective views of an upper bag holder frame attached to the carrier of FIG. 1, in which:

FIG. 12A shows a coupling member used for coupling the holder frame to the handle frame; and FIG. 12B shows the holder frame assembled with the coupling member;

DESCRIPTION OF THE PREFERRED EMBODIMENTS

Figure 1:
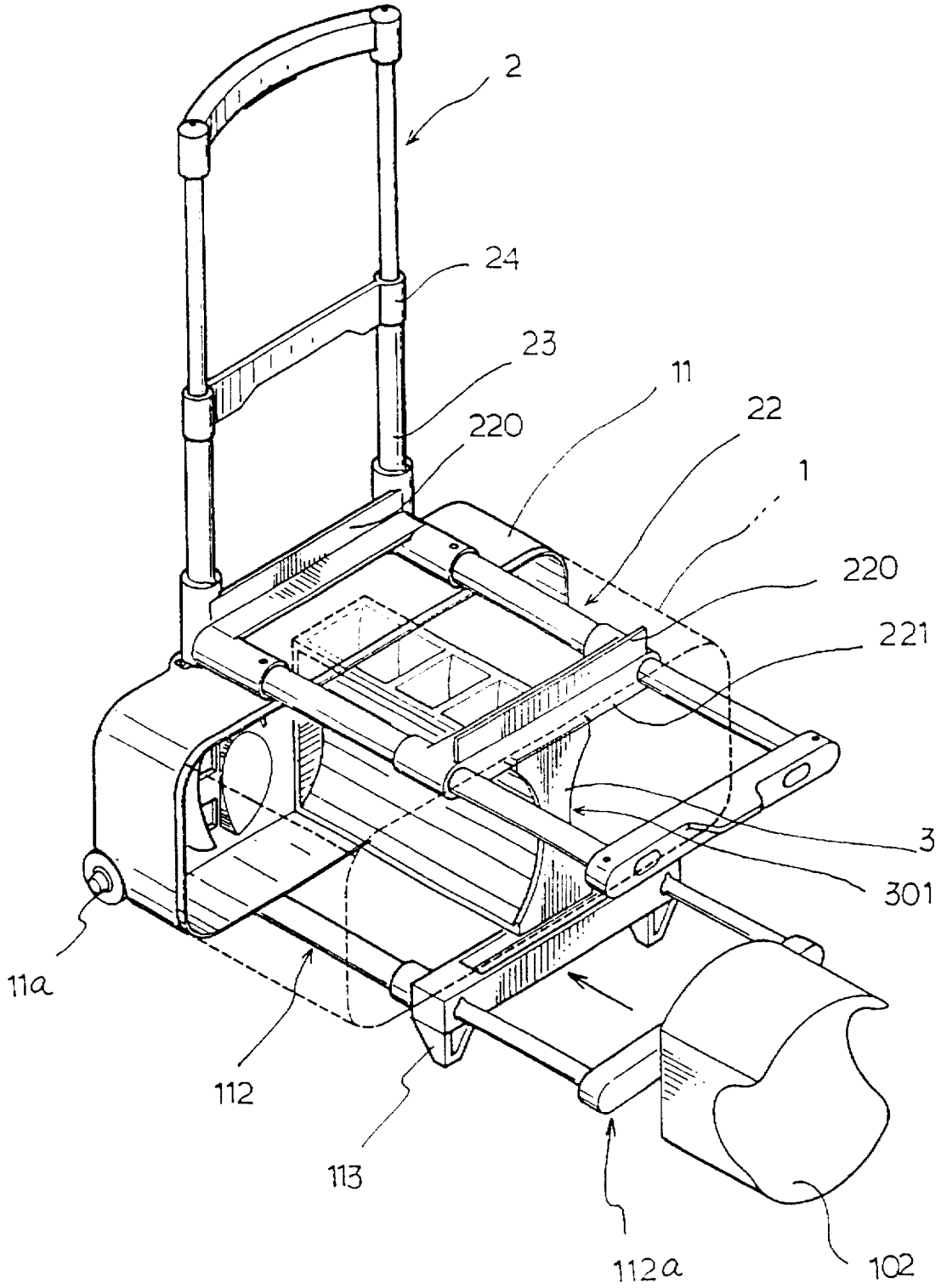

FIGS. 1 to 5 show a bowling ball carrier, having a construction capable of holding two or more bags, in accordance with the invention.

As shown in the drawings, the bowling ball carrier of this invention regardless of the embodiments has a telescopic handle frame 2, which is coupled to the wheeled bottom part 11 of a bowling ball bag 1 at the lower end. An upper bag holder frame 22 is attached to the handle frame 2 at a position above the bag 1 and holds another bag 1 thereon. The carrier thus effectively holds two or more bowling ball bags 1 at the same time.

Figure 2:
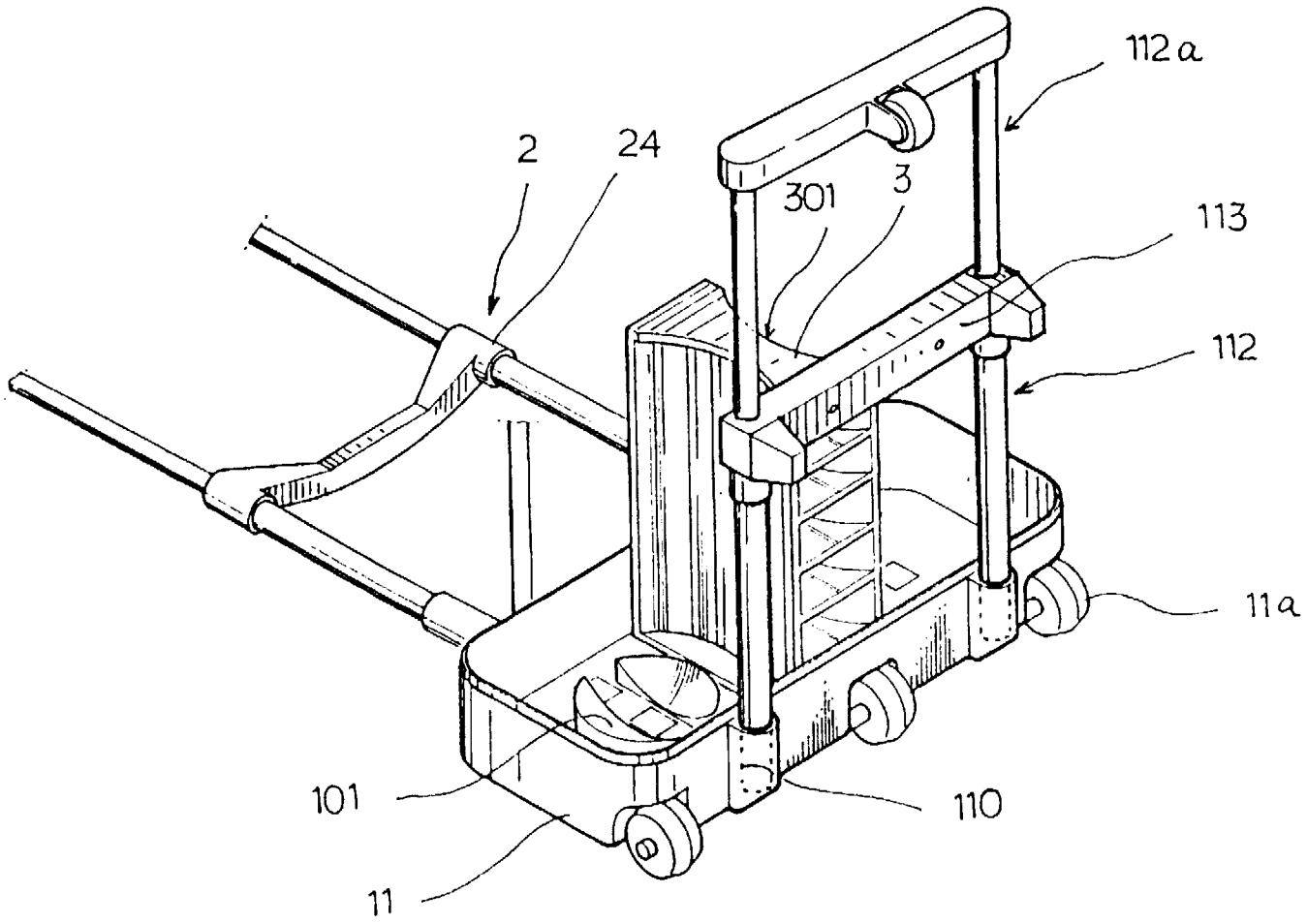
FIG. 2 is a bottom perspective view of the bowling ball carrier of FIG. 1.
Figure 3:
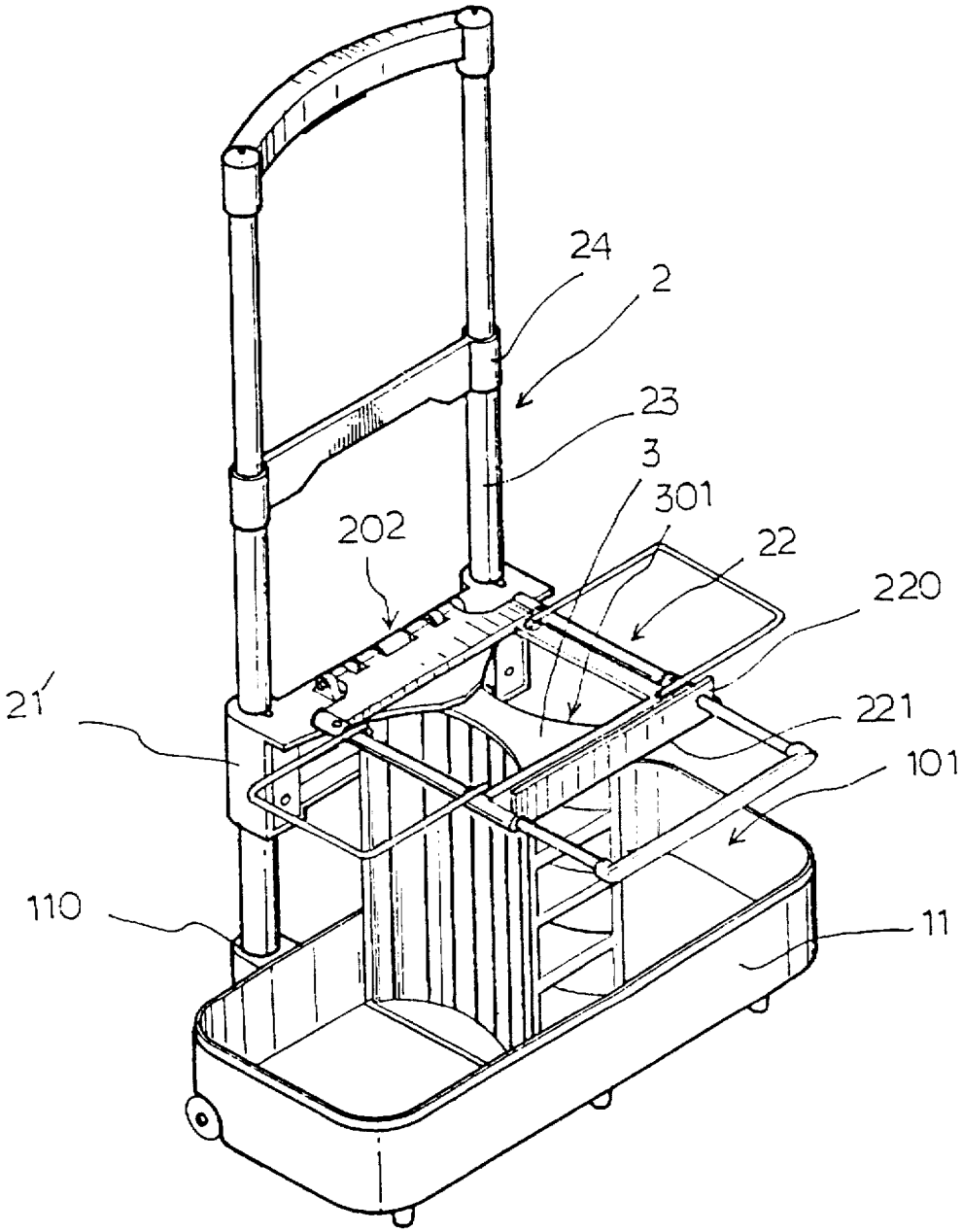
FIG. 3 is a perspective view showing a bowling ball carrier, with an integrated bag standing on its bottom thus allowing a user to receive or take bowling balls into or out of the bags from the top, in accordance with another embodiment of this invention.
Figure 4:
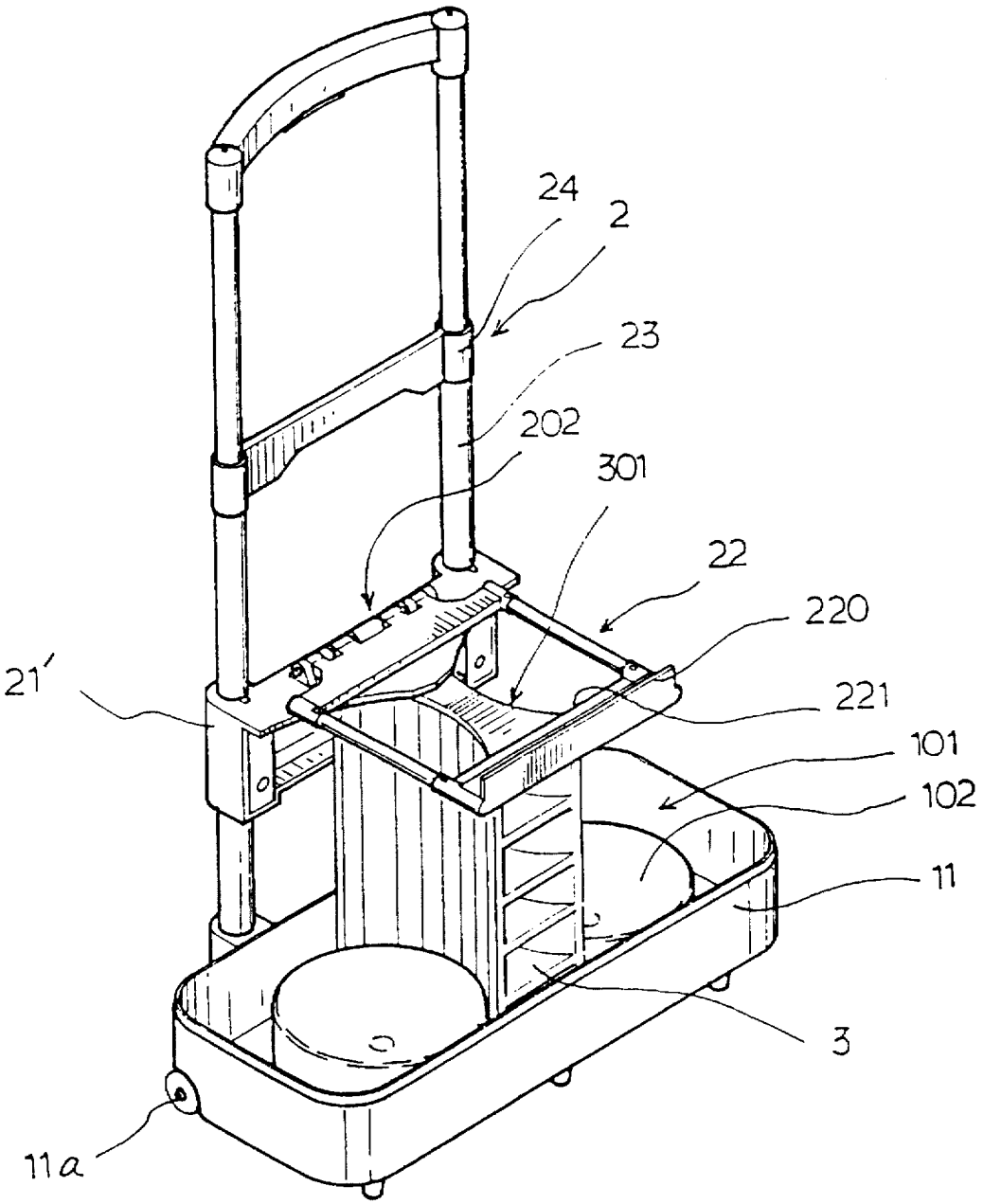
FIG. 4 is a perspective view showing a bowling ball carrier, provided with two ball cups in addition to the construction of the carrier of FIG. 3, in accordance with a further embodiment of this invention.

As shown in FIGS. 1 to 4, the bottom part 11 of the integrated bag 1 has a plurality of, preferably, two pipe sockets 110 on the outside wall. The pipe sockets 110 may be coupled to the lower ends of two longitudinal pipes of the handle frame 2 as shown in FIGS. 3 and 4. Alternatively, the pipe sockets 110 may be coupled to two pipes of a bottom holder frame 112, which has a telescopic part 112*a* at the front end, as shown in FIGS. 1 and 2. That is, the bottom part 11 of the integrated bag 1 may be selectively positioned on the carrier in one of two positions: a lying position where the opening 101 of the bottom part 11 is directed to the front as shown in FIGS. 1 and 2 and a standing position where the opening 101 is directed to the top as shown in FIGS. 3 and 4.

The above bottom part 11, which has the pipe sockets 110 on the outside wall, also has a fitting means on the outside bottom. When the integrated bag 1 is positioned on the carrier with the opening 101 of the bottom part 11 being directed to the front as shown in FIGS. 1 and 2, the two longitudinal pipes of the handle frame 2 engage with the fitting means of the bottom part 11. In this case, the side wall of the bottom part 11, having the pipe sockets 110, is directed downward so that the bottom holder frame 112, having the telescopic part 112*a* at the front end, can be fitted into the pipe sockets 110 and effectively holds the integrated bag 1 thereon. A bow support block 3 is held on the bottom part 11 inside the integrated bag 1. The upper bag holder frame 22, having a telescopic structure, is coupled to the handle frame 2 through two coupling pipes 21 at a position above the integrated bag 1 and holds an upper bag 1 thereon.

Figure 14:
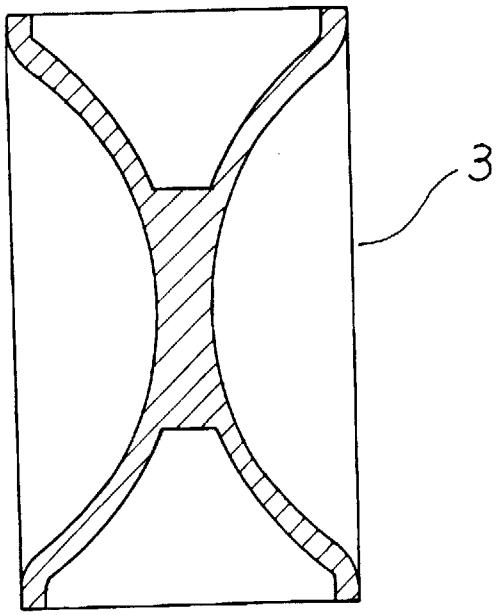
FIG. 14 is a sectional view of the bow support block of FIG. 13, showing both smoothly-rounded sides of the support block.
Figure 13:
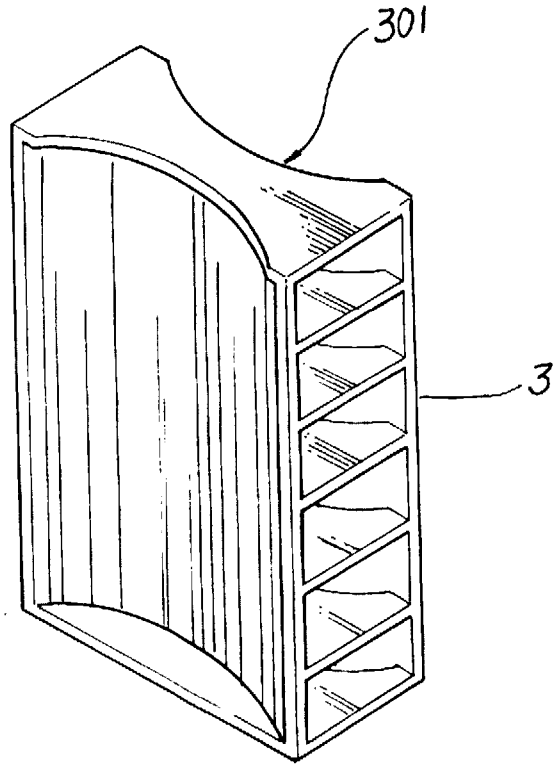
FIG. 13 is a perspective view showing the configuration of a bow support block of the bowling ball carrier according to this invention.

Meanwhile, when the integrated bag 1 is positioned on the carrier with the opening 101 of the bottom part 11 being directed to the top as shown in FIGS. 3 and 4, the two longitudinal pipes of the handle frame 2 are fitted into the pipe sockets 110 of the bottom part 11 at the lower ends. The bow support block 3 is held on the center of the bottom part 11 inside the opening 101. In this embodiment, the upper bag holder frame 22 is hinged to the handle frame 2 at a position above the integrated bag 1 and holds an upper bag 1 thereon. That is, the upper bag holder frame 22 is hinged to a fixed support beam 21', which is attached to the handle frame 2, through a hinged joint 202 so that the frame 22 is rotatable around the hinged joint 202. In this case, the lowermost position of the hinged frame 22 is not lower than the horizontal position since the inside end of the frame 22 is stopped by the flat top surface of the support beam 21' when the frame 22 is rotated into the lowermost position. The outside end of the upper bag holder frame 22 has a support wall 221, thus stably holding the upper bag 1 on the frame 22 and preventing the bag 1 from being unexpectedly separated from the frame 22. As best seen in FIGS. 13 and 14, each side wall 301 of the support block 3 is rounded inwardly at the same radius of gyration as a bowling ball 4 so that the support block 3 is smoothly constricted in the middle and thereby is called by the term "bow support block". In the embodiment of FIGS. 1 and 2, the bow support block 3 is positioned on the bottom part 11 of the integrated bag 1, with the bow side walls 301 of the support block 3 extending horizontally. Meanwhile, in the embodiment of FIGS. 3 and 4, the support block 3 is positioned on the bottom part 11 in a way such that the bow side walls 301 extend vertically.

Figure 12:
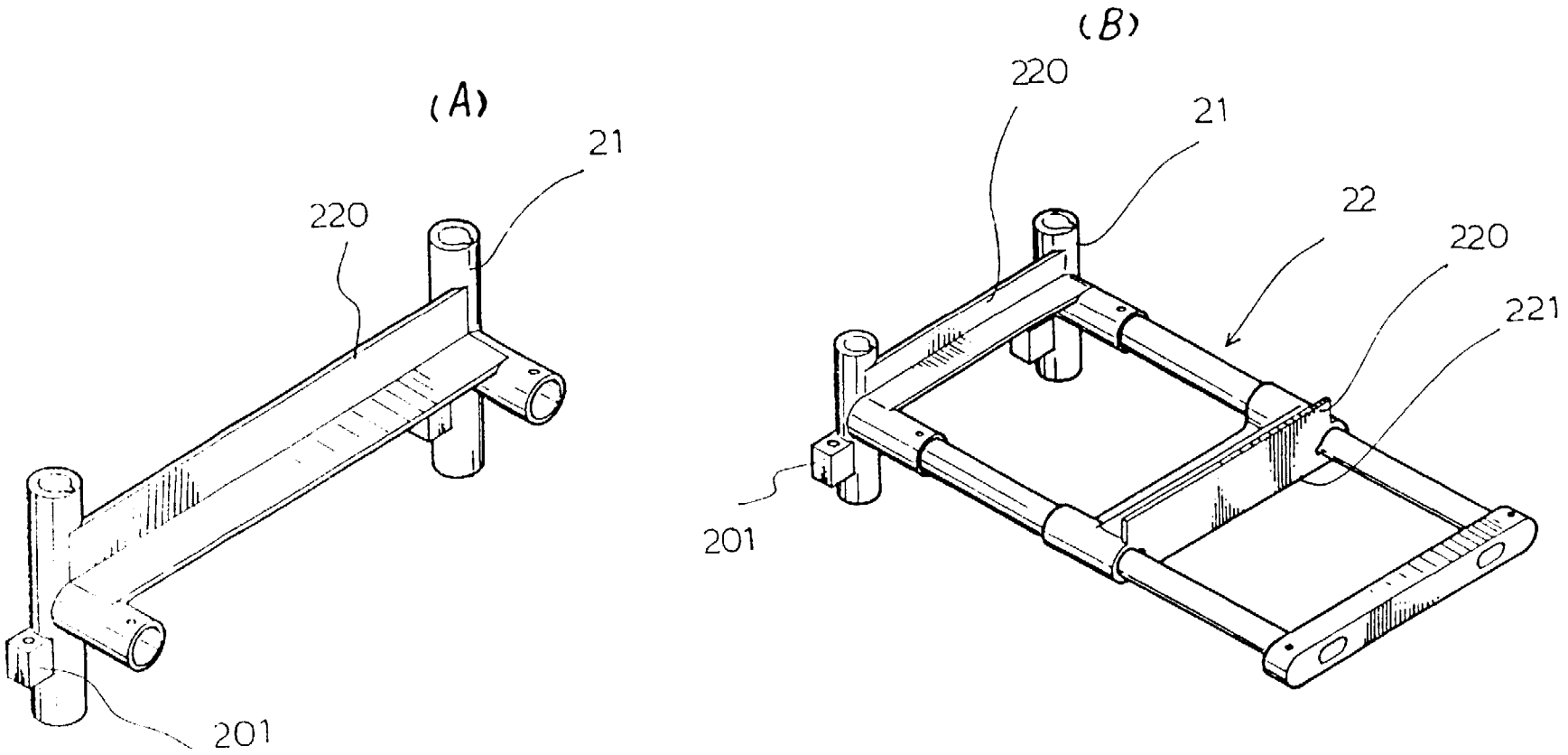

The upper bag holder frame 22 of the invention is attached to the telescopic handle frame 2 at a position above the integrated bag 1 and holds the upper bag 1 thereon. In the embodiment of FIGS. 1 and 2, the upper bag holder frame 22 is attached to the handle frame 2 through the two T-shaped coupling pipes 21, which are fitted over the two telescopic longitudinal pipes of the handle frame 2. The construction of the above frame 22 is best seen in FIGS. 12A and 12B. Each of the T-shaped coupling pipes 21 has a fixture 201 on the outside wall and is fixed to the bottom part 11 of the integrated bag 1 through the fixture 201. The upper bag holder frame 22, having a telescopic structure, is coupled to the coupling pipes 21 by fitting two longitudinal main pipes of the frame 22 into the coupling pipes 21. An inside support wall 220 integrally extends between the two coupling pipes 21, while an outside support wall 220 extends between the outside ends of the two main pipes of the frame 22. The two support walls 220 of the upper bag holder frame 22 hold the upper bag 1 on the frame 22 and prevent the bag 1 from being unexpectedly separated from the frame 22.

Figure 11:
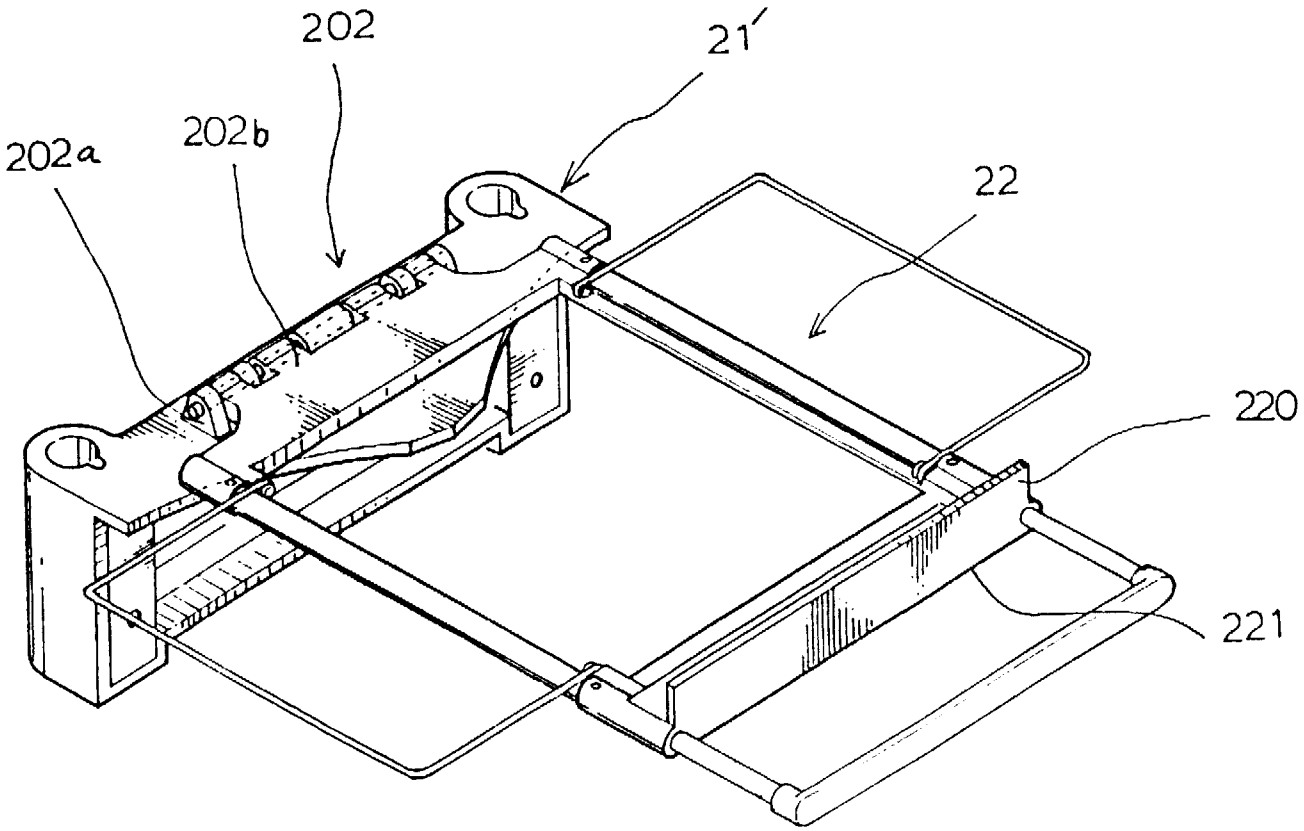
FIG. 11 is a perspective view showing the construction of an upper bag holder frame attached to the carrier of FIG. 3.

In the embodiment of FIGS. 3 and 4, the upper bag holder frame 22 is hinged to the fixed support beam 21', which is mounted to the telescopic handle frame 2, through the hinged joint 202 so that the frame 22 is rotatable around the hinged joint 202 with the lowermost position of the frame 22 being not lower than the horizontal position. The construction of the above frame 22 is best seen in FIG. 11. The hinged joint 202 comprises a plurality of fixed and movable bosses 202*a* and 202*b* which are hinged together using a hinge pin. The fixed bosses 202*a* are formed on the support beam 21', while the movable bosses 202*b* are formed on the inside end of the frame 22. In the same manner as described for the embodiment of FIGS. 1 and 2, an outside support wall 220 extends between the outside ends of the two main pipes of the frame 22 and has the same function as described above.

In the embodiment of FIGS. 1, 2, 6 and 7, the integrated bag 1 is coupled to the handle frame 2, with the opening 101 of the bottom part 11 of the bag 1 being directed to the front. In this case, the bow support block 3 is positioned on the bottom part 11, with the bow side walls 301 extending horizontally. The bottom holder frame 112 of this embodiment is provided with two ground stands 113 on the bottom and is tightly inserted into the two pipe sockets 110 of the bottom part 11 so that the frame 112 stably holds the integrated bag 1 thereon. Meanwhile, in the embodiment of FIGS. 3, 4 and 8, the integrated bag 1 is coupled to the handle frame 2, with both the opening 101 of the bottom part 11 being directed to the top and the lower ends of the two main pipes of the handle frame 2 being inserted into the two pipe sockets 110 of the bottom part 11. In this case, the bow support block 3 is positioned on the bottom part 11, with the bow side walls 301 extending vertically.

Figure 8:
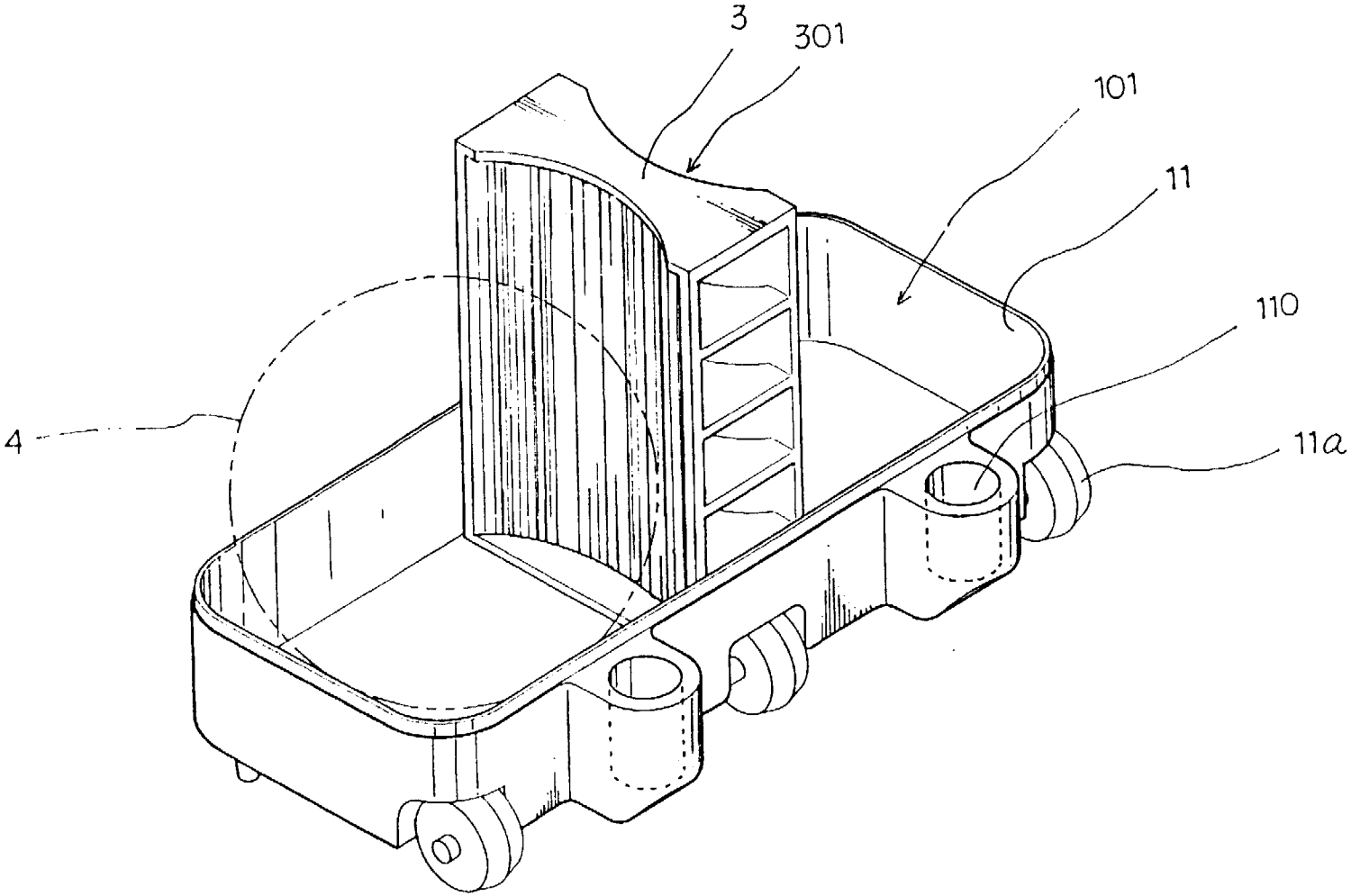
FIG. 8 is a perspective view showing the construction of the bottom part of the integrated bag of FIG. 3.
Figure 9:
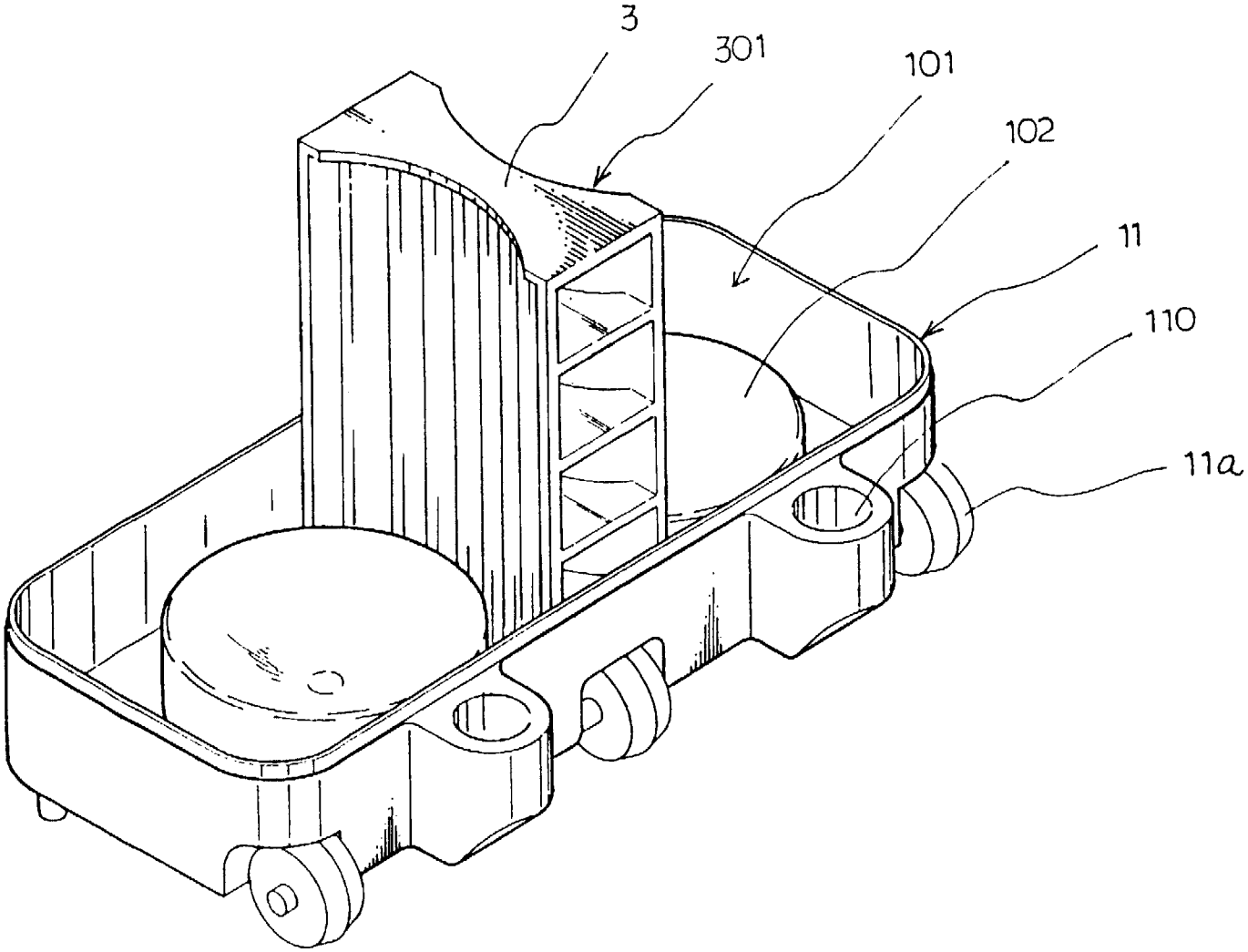
FIG. 9 is a view corresponding to FIG. 8, but showing the bottom part of the integrated bag with ball cups.
Figure 10:
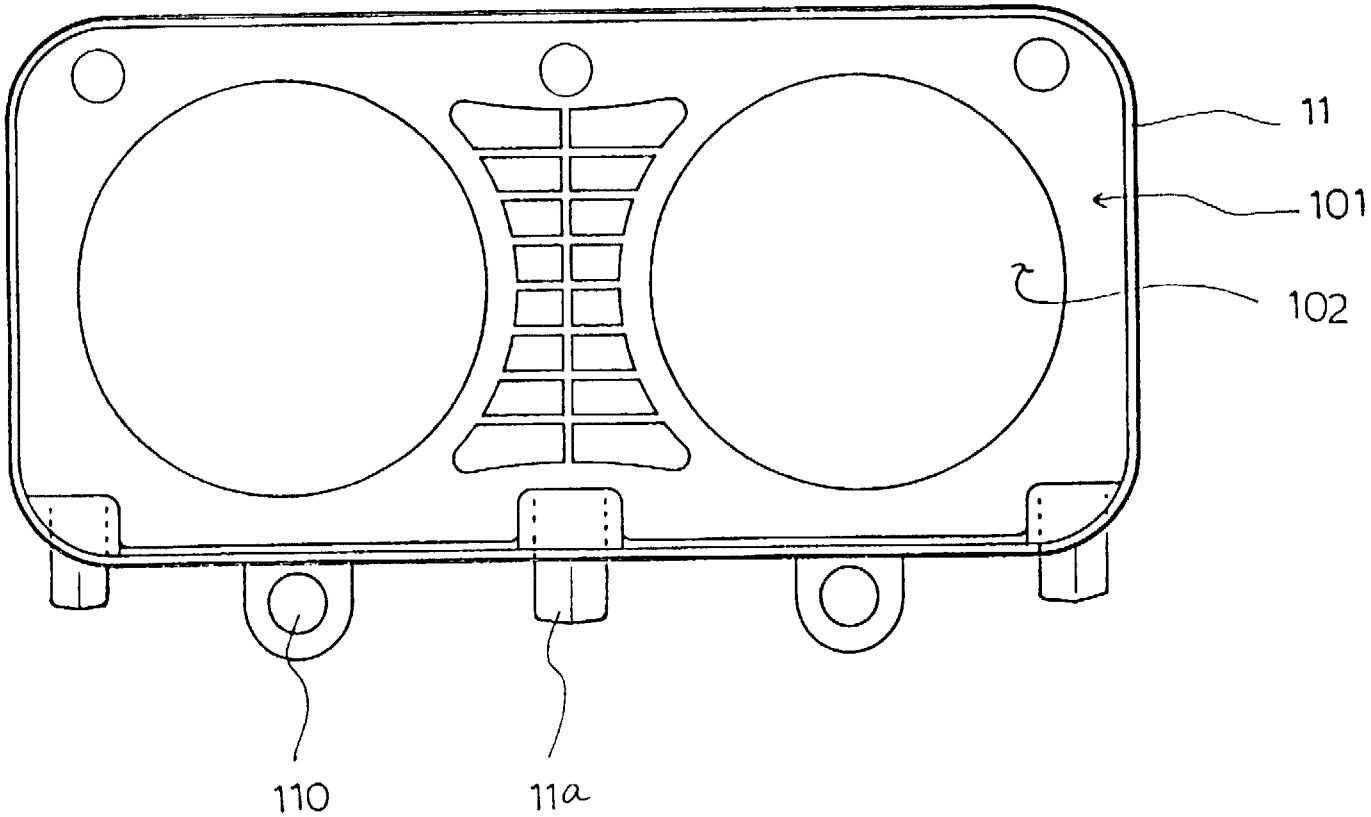
FIG. 10 is a plan view of the bottom part of FIG. 9.

As shown in FIGS. 9 and 10, a plurality of, preferably, two ball cups 102 may be provided on the inside bottom of the bottom part 11 of FIG. 8 for holding the bowling balls 4.

Figure 5:
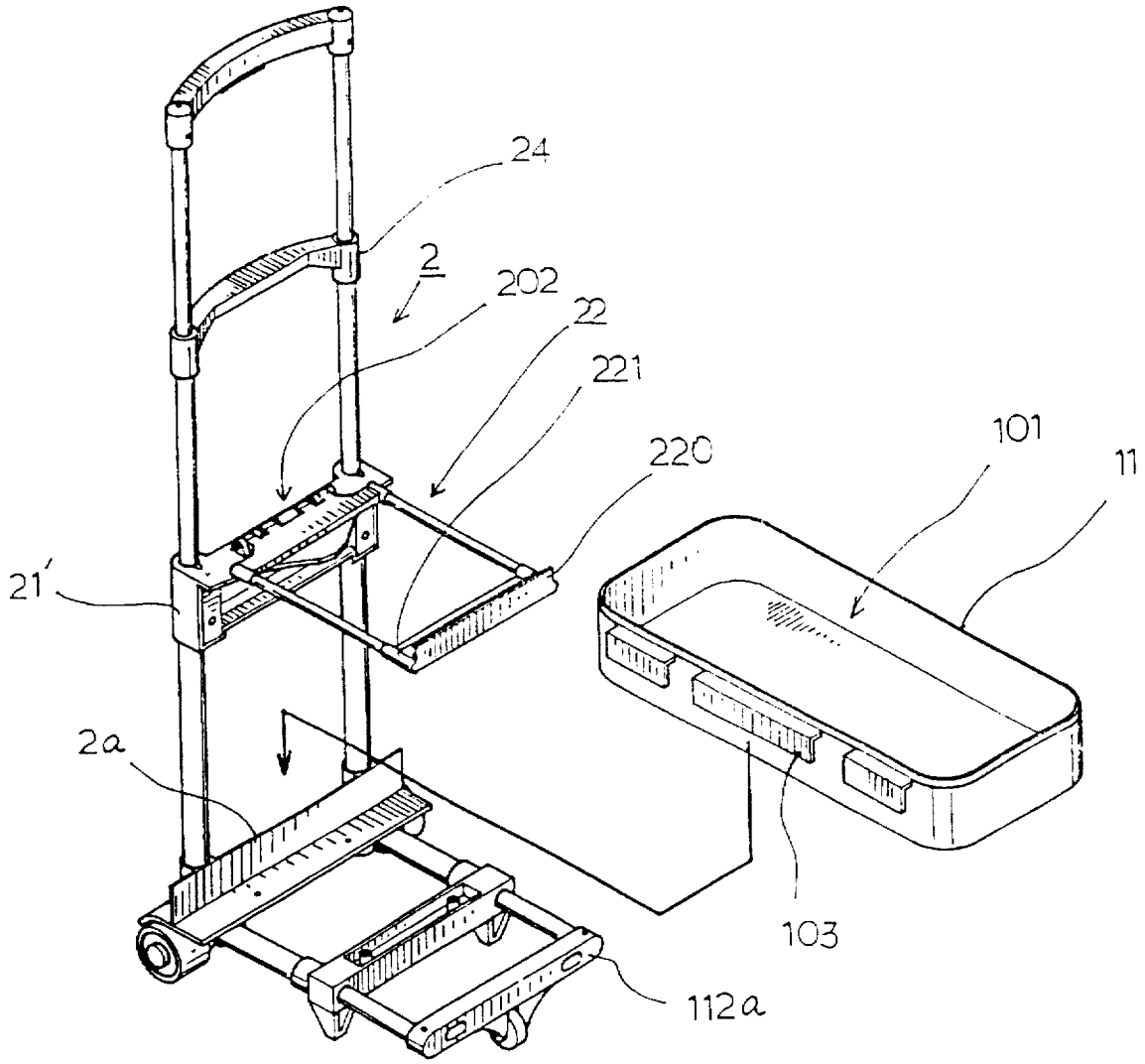
FIG. 5 is a perspective view showing the framework of the bowling ball carrier, suitable for receiving or taking bowling balls into or out of the bags from the top, according to this invention.
Figure 6:
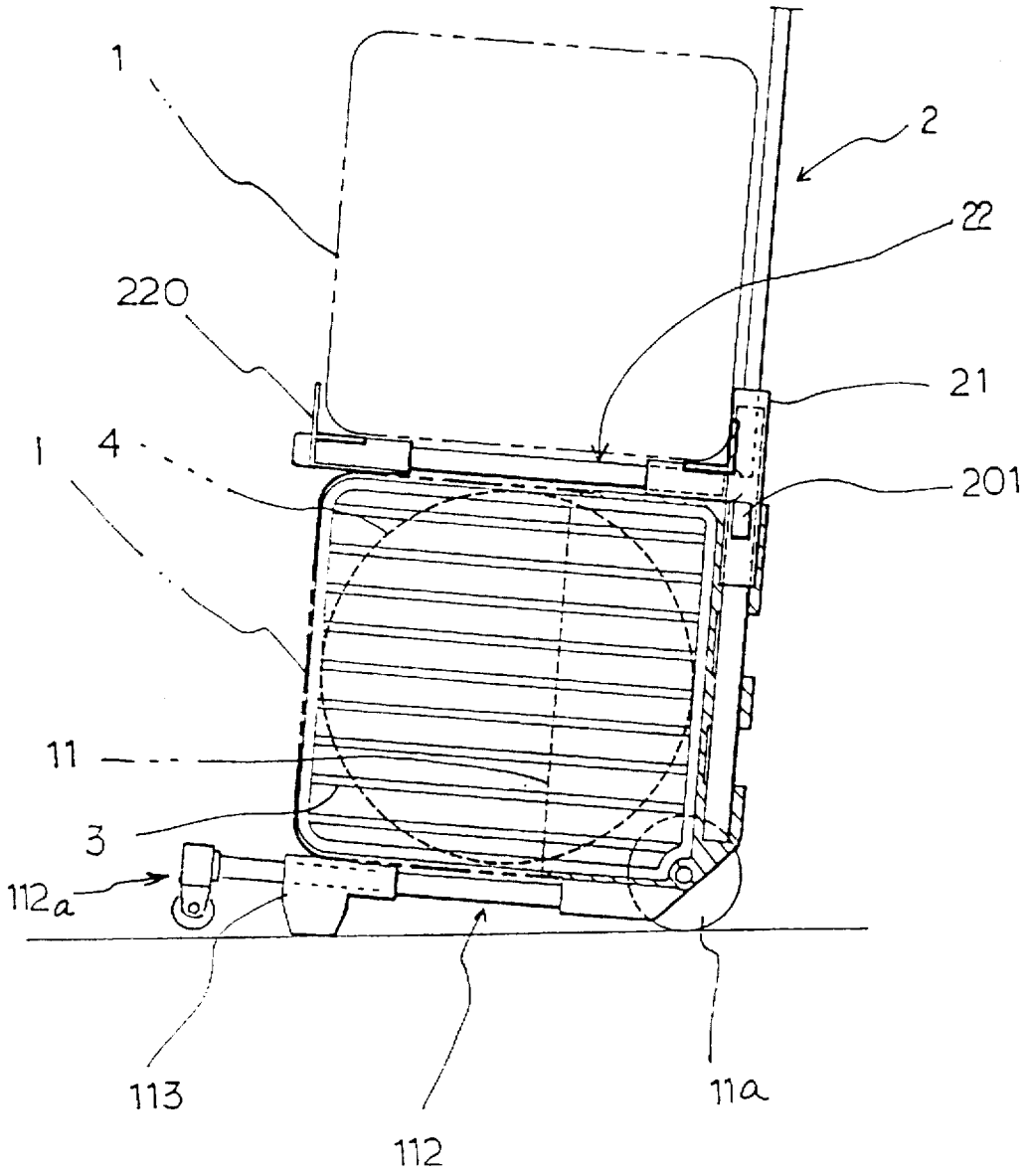
FIG. 6 is a side view of the bowling ball carrier of FIG. 1.
Figure 7:
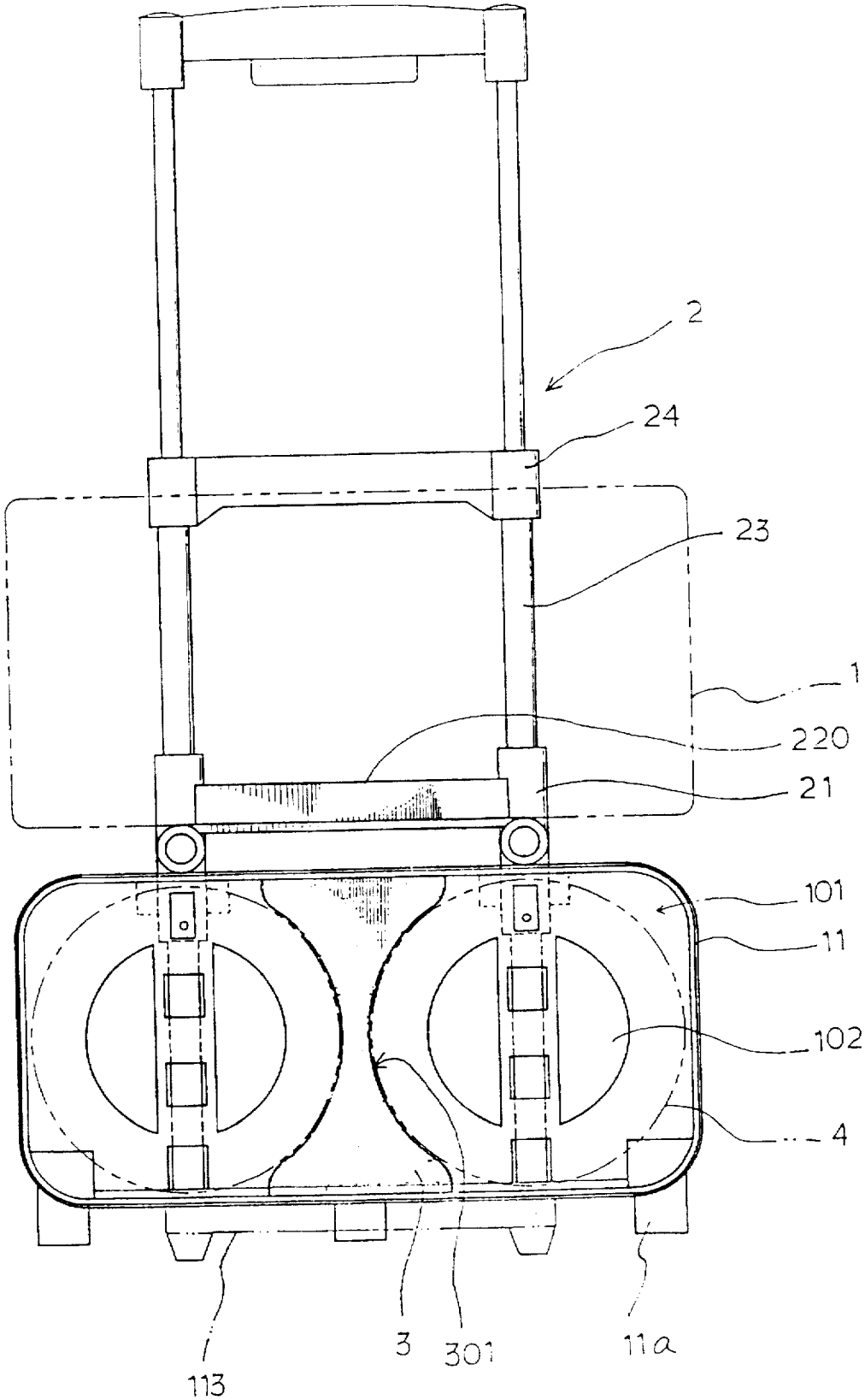
FIG. 7 is a front view of the bowling ball carrier of FIG. 1.

FIG. 5 shows a bowling ball carrier according to a further embodiment of this invention. In this embodiment, the bowling ball carrier is formed by attaching the upper bag holder frame 22 to the two longitudinal pipes of the handle frame 2 of a conventional wheeled carrier having an integrated holder frame on the bottom. In addition, the bottom part 11 of an integrated bag is installed on the integrated holder frame of the carrier by fitting a hook 103 onto the inside support wall 2*a*, which is provided on the inside end of the integrated holder frame. The hook 103 is provided on the rear outside wall of the bottom part 11.

Figure 15:
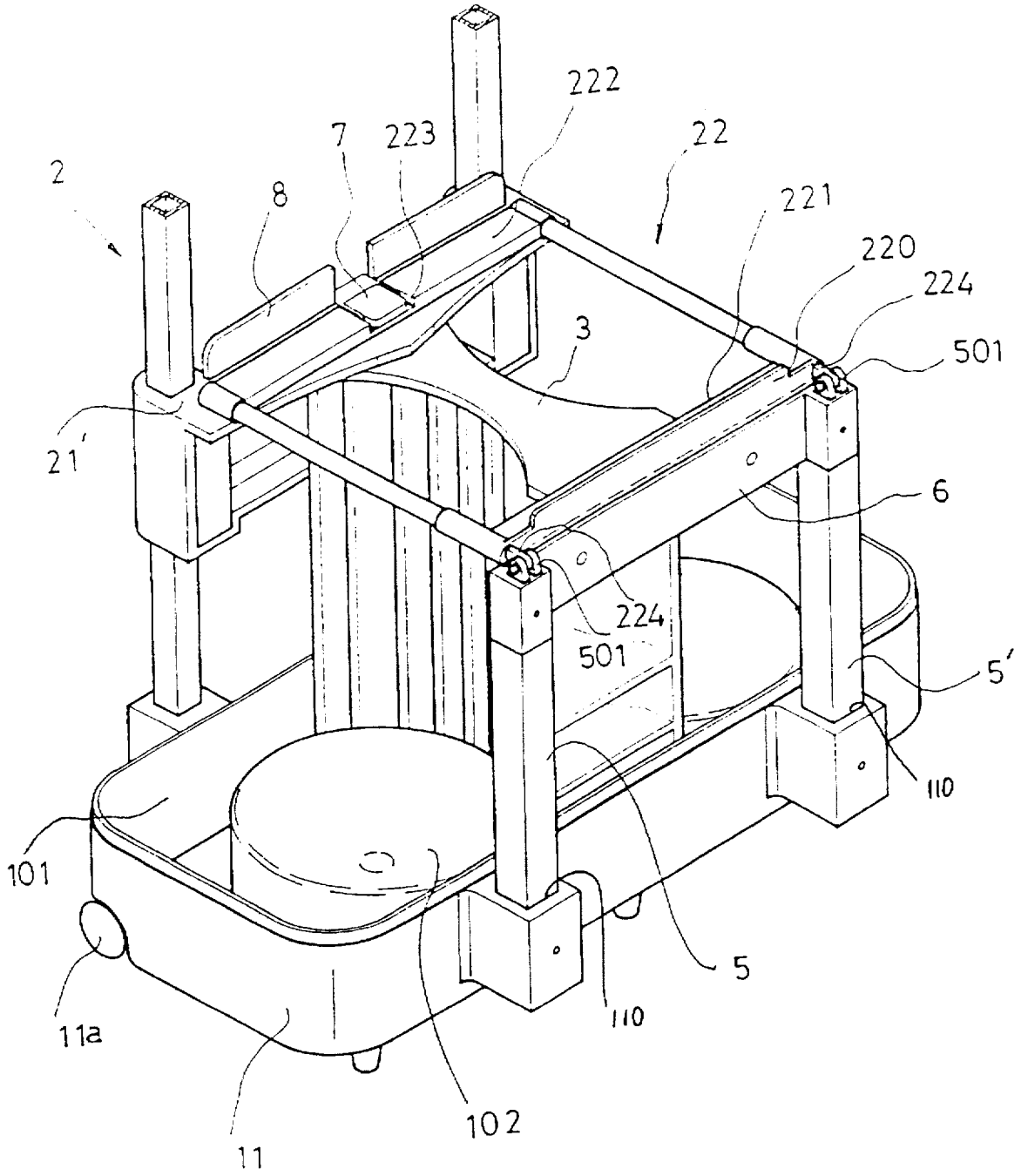
FIG. 15 is a perspective view of a bowling ball carrier with an upper bag holder frame in accordance with yet another embodiment of this invention.

FIG. 15 shows a bowling ball carrier in accordance with yet another embodiment of this invention. In this embodiment, the integrated bag 1 is positioned on the carrier with the opening 101 of the bottom part 11 being directed to the top. However, this embodiment alters the construction of both the bottom part 11 and the upper bag holder frame 22 as follows. That is, the bottom part 11 has a plurality of, preferably, two column holders, which are formed on the front outside wall of the part 11 and hold two support columns 5 and 5'. The top ends of the support columns 5 and 5' are connected together by a connection beam 6 and individually have a boss 501. The outside ends 224 of two longitudinal pipes of the upper bag holder frame 22 are hinged to the bosses 501 of the columns 5 and 5' so that the frame 22 may be rotatable around the bosses 501 of the columns 5 and 5'. The upper bag holder frame 22 also has an outside support wall 221, which is formed on the connection beam 6. An inside connection beam 222 extends between the inside ends of the two pipes of the frame 22 and has a slot 223 on the top center. Placed on the slot 223 of the inside connection beam 222 is a lock member 7. A support beam 21' is attached to the handle frame 2 and has a support wall 8 on the top surface. The support wall 8 is cut at the center into two parts. The lock member 7 of the inside connection beam 222 selectively engages with the cut center of the support wall 8, thus holding the upper bag holder frame 22 in the horizontal position.

In the drawings, the reference numeral 11*a* denotes a wheel which is provided on each bottom corner of the bottom part 11 of the integrated bag 1.

As described above, the bowling ball carrier of this invention holds an integrated bag 1 on the bottom portion. The carrier also holds another bag 1 at a position above the integrated bag 1 so that the carrier can easily and effectively carry a plurality of bowling balls 4 at the same time. As shown in FIGS. 1 and 2, the integrated bag 1 may be coupled to the handle frame 2, with the opening 101 of the bottom part 11 of the bag 1 being directed to the front. In this case, the bow support block 3 is positioned on the bottom part 11, with the bow side walls 301 of the block 3 extending horizontally. In addition, the upper bag holder frame 22 is coupled to the handle frame 2 through the two coupling pipes 21 at a position above the integrated bag 1.

Meanwhile, the integrated bag 1 may be coupled to the handle frame 2, with the opening 101 of the bottom part 11 of the bag 1 being directed to the top as shown in FIGS. 3 and 4. In this case, the bow support block 3 is positioned on the bottom part 11, with the bow side walls 301 extending vertically. The upper bag holder frame 22 is coupled to the handle frame 2 at a position above the integrated bag 1 in a way such that the upper bag holder frame 22 is rotatable. In order to make the upper bag holder frame 22 rotatable, the frame 22 may be hinged to the fixed support beam 21', which is attached to the handle frame 2, through the hinged joint 202 comprising a plurality of fixed and movable bosses 202*a* and 202*b* as shown in FIG. 11. Alternatively, the upper bag holder frame 22 may be hinged to the bosses 501 of the support columns 5 and 5' so that the frame 22 may be rotatable around the bosses 501 of the columns 5 and 5' as shown in FIG. 15. Therefore, the carrier with such a hinged upper bag holder frame 22 according to this invention allows a user to easily receive or take bowling balls 4 into or out of the integrated bag 1 and holds another bag 1 on the upper bag holder frame 22 thus easily carrying two or more bowling balls 4 at the same time.

In the embodiment of FIG. 15, the upper bag holder frame 22 also has the lock member 7 on the slot 223 of the inside connection beam 222 so that the lock member 7 selectively engages with the inside support wall 8 of the support beam 21' thus stably holding the upper bag holder frame 22 in the horizontal position. Therefore, the carrier of FIG. 15 effectively holds another bag 1 on the upper bag holder frame 22.

When the integrated bag 1 is positioned on the carrier as shown in FIGS. 3 and 4, the two longitudinal pipes of the handle frame 2 are fitted into the pipe sockets 110 of the bottom part 11 of the bag 1 at the lower ends. Meanwhile, when the integrated bag 1 is positioned as shown in FIGS. 1 and 2, the two longitudinal pipes of the handle frame 2 engage with the fitting means of the bottom part 11. In this case, the bottom holder frame 112 is fitted into the pipe sockets 110 of the bottom part 11 of the integrated bag 1. In the embodiment of FIGS. 1 and 2, the telescopic part 112*a* of the bottom holder frame 112 may extend forward to hold bowling equipment.

Both side walls 301 of the bow support block 3, which is arranged inside the bottom part 11 of the bag 1, are rounded inwardly at the same radius of gyration as a bowling ball 4. When such a support block 3 is arranged inside the bottom part 11 of the integrated bag 1, the support block 3 effectively isolates the bowling balls 4 from each other and prevents the balls 4 from frictional contact with each other. It is thus possible to prevent unexpected scratching or damage of the balls 4 while carrying them. The support block 3 also effectively supports the upper bag 3, filled with heavy bowling balls 4, in cooperation with the upper bag holder frame 22 thus preventing the bottom holder frame 112 from sagging due to the weight of the upper bag 1.

When the integrated bag 1 is positioned on the carrier with the opening 101 of the bottom part 11 of the bag 1 being directed to the front, the upper bag holder frame 22 of FIGS. 12A and 12B is attached to the handle frame 2 at a position above the integrated bag 1. In this case, the inside and outside support walls 220, which are provided on the upper bag holder frame 22, effectively hold the upper bag 1 so that a bag is effectively prevented from unexpected separation from the upper bag holder frame 22.

In the carrier of this invention, the handle frame 2 has a telescopic structure, which comprises two main pipes and two telescopic pipes. The telescopic pipes of the handle frame 2 are coupled to the main pipes 23 with a telescopic control member 24 being installed in the junction between the main and telescopic pipes.

In the present invention, the bottom part 11 of an integrated bag 1 may be free from the bow support block 3 inside the opening 101. The carrier with the integrated bag 1 free from the support block 3 may be preferably used as a travelling carrier with the integrated bag 1. When the carrier of this invention is used as a travelling carrier, another bag may be held on the upper bag holder frame 22 without deforming the integrated bag 1 or damaging the contents of the bags.

As described above, the present invention provides a bowling ball carrier, which effectively and stably holds two or more bowling ball bags without deforming the bags or damaging the contents of the bags and allows a user to easily and simply receive or take bowling balls into or out of the bags thus being convenient to users. The bowling ball bag attached to the carrier of this invention has a strong and simple construction and is provided with a bow support block for isolating the bowling balls from each other so that the bag does not cause deformation or damage of the balls. When the bow support block is removed from the bag of the carrier according to this invention, the carrier can be preferably used as a travelling carrier.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A bowling ball carrier comprising:

a handle frame having a telescopic structure;

an integrated bag provided on the lower end of said handle frame by attaching the bottom part of said bag to the lower end of the handle frame;

a support block placed in said bottom part of the bag; and an upper bag holder frame used for holding an additional bag thereon, said upper bag holder frame being attached to said handle frame at a position above the integrated bag and supported by said support block.

2. The bowling ball carrier according to claim 1, wherein said bottom part of the integrated bag includes a wheel on each bottom corner, side socket means on the outside wall and bottom socket means on the outside bottom.

3. The bowling ball carrier according to claim 2, wherein said bottom part of the integrated bag stands on its bottom, with said side socket means being coupled to the lower end of the handle frame.

4. The bowling ball carrier according to claim 2, wherein said bottom part of the integrated bag lies on its side, with both said bottom socket means being coupled to the lower end of the handle frame and said side socket means being coupled to a bottom holder frame used for holding the integrated bag lying on its side.

5. The bowling ball carrier according to claim 1, wherein said upper bag holder frame is hinged to a fixed support beam attached to said handle frame thus being rotatably held on the handle frame.

6. The bowling ball carrier according to claim 1, wherein said upper bag holder frame is attached to the handle frame through a T-shaped coupling pipe, said coupling pipe having a fixture on the outside wall and being fixed to the bottom part of the integrated bag through said fixture.

7. The bowling ball carrier according to claim 1, wherein said upper bag holder frame has a support wall on the outside end, said support wall holding the additional bag on the upper bag holder frame.

8. The bowling ball carrier according to claim 1, wherein both side walls of said support block are rounded inwardly at the same radius of gyration as a bowling ball thus forming bow side surfaces.

9. The bowling ball carrier according to claim 8, wherein said support block is positioned inside the bottom part of the integrated bag, with the bow side surfaces extending horizontally in the event of the integrated bag lying on its side or extending vertically in the event of the integrated bag standing on its bottom.

10. The bowling ball carrier according to claim 1, wherein said bottom part of the integrated bag has a hook on the rear outside wall and is attached to said handle frame by fitting said hook onto a support wall provided on the lower end of the handle frame.

11. The bowling ball carrier according to claim 4, wherein said bottom holder frame has a telescopic structure.

12. The bowling ball carrier according to claim 1, wherein said handle frame is made of a pipe having a rectangular cross-section.

13. The bowling ball carrier according to claim 1, further comprises:

two vertical support columns held on the outside wall of said bottom part of the integrated bag at a position opposite to the handle frame, the top ends of said support columns being connected together by an outside connection beam and individually having a boss, said boss being hinged to the outside end of said upper bag holder frame thus rotatably holding the upper bag holder frame on the support columns;

an outside support wall formed on said outside connection beam and adapted for holding the additional bag on the upper bag holder frame;

an inside connection beam provided on the inside end of the upper bag holder frame and having a slot on the top center;

a support beam attached to said handle frame and having a support wall on the top surface, said support wall being cut at the center into two parts; and a lock member provided on said slot of the inside connection beam, said lock member selectively engaging with the center of said support wall of the support beam thus holding the upper bag holder frame in a horizontal position.

* * * * *